US010030449B2

(12) United States Patent
Egerström

(10) Patent No.: US 10,030,449 B2
(45) Date of Patent: Jul. 24, 2018

(54) APPARATUS FOR DRILLING AND LINING A BOREHOLE

(71) Applicant: LKAB WASSARA AB, Huddinge (SE)

(72) Inventor: Fredrik Egerström, Nacka (SE)

(73) Assignee: LKAB WASSARA AB, Huddinge (CH)

( * ) Notice: Subject to any disclaimer, the term of this patent is extended or adjusted under 35 U.S.C. 154(b) by 334 days.

(21) Appl. No.: 14/389,973

(22) PCT Filed: Mar. 11, 2013

(86) PCT No.: PCT/SE2013/050215
§ 371 (c)(1),
(2) Date: Oct. 1, 2014

(87) PCT Pub. No.: WO2013/151477
PCT Pub. Date: Oct. 10, 2013

(65) Prior Publication Data

US 2015/0330151 A1 Nov. 19, 2015

(30) Foreign Application Priority Data

Apr. 4, 2012 (SE) ..... 1250345-4

(51) Int. Cl.
*E21B 1/00* (2006.01)
*E21B 10/36* (2006.01)
(Continued)

(52) U.S. Cl.
CPC ..... *E21B 7/20* (2013.01); *E21B 1/00* (2013.01); *E21B 3/00* (2013.01); *E21B 4/14* (2013.01);
(Continued)

(58) Field of Classification Search
CPC ... E21B 7/20; E21B 4/14; E21B 10/36; E21B 17/14; E21B 7/208
See application file for complete search history.

(56) References Cited

U.S. PATENT DOCUMENTS

2004/0104050 A1 6/2004 Järvelä et al.
2010/0264608 A1* 10/2010 Wolfer ..... E21B 17/076 279/19

FOREIGN PATENT DOCUMENTS

DE 4000691 A1 7/1991
EP 1837481 A1 9/2007
(Continued)

OTHER PUBLICATIONS

International Preliminary Report on Patentability received for PCT Patent Application No. PCT/SE2013/050215, dated Oct. 16, 2014, 6 pages.
(Continued)

*Primary Examiner* — Giovanna C. Wright
*Assistant Examiner* — Brandon M Duck
(74) *Attorney, Agent, or Firm* — Morrison & Foerster LLP

(57) ABSTRACT

An arrangement at a drill includes a drill bit intended to be inserted at its neck into a chuck in a down-the-hole drill, a control means for guiding the drill and a lining pipe, a coupling arrangement in the form of a bayonet coupling or similar with which the drill can be coupled to the control means in a manner that allows them to be separated and that in its freed condition allows the drill, together with the down-the-hole drill, to be withdrawn through the lining pipe, a flushing passage for the supply of flushing agent in front of the drill and an evacuation passage for the removal of drilling cuttings together the flushing agent. It also includes a casing shoe that can be applied at the forward end of the lining pipe and a contact surface arranged at a stationary part of the down-the-hole drill.

13 Claims, 3 Drawing Sheets

(51) Int. Cl.

| | |
|---|---|
| ***E21B 17/14*** | (2006.01) |
| ***E21B 3/00*** | (2006.01) |
| ***E21B 7/20*** | (2006.01) |
| ***E21B 10/64*** | (2006.01) |
| ***E21B 21/12*** | (2006.01) |
| ***E21B 4/14*** | (2006.01) |
| ***E21B 17/046*** | (2006.01) |

(52) U.S. Cl.
CPC ..... *E21B 7/208* (2013.01); *E21B 10/36* (2013.01); *E21B 10/64* (2013.01); *E21B 17/046* (2013.01); *E21B 17/14* (2013.01); *E21B 21/12* (2013.01)

(56) References Cited

FOREIGN PATENT DOCUMENTS

| | | | | |
|---|---|---|---|---|
| WO | 1996/015351 | A1 | 5/1996 | |
| WO | 99/34087 | A1 | 7/1999 | |
| WO | WO 2010071563 | A1 * | 6/2010 | ..... E21B 7/20 |

OTHER PUBLICATIONS

International Written Opinion received for PCT Patent Application No. PCT/SE2013/050215, dated Jul. 1, 2013, 4 pages.
International Search Report received for PCT Patent Application No. PCT/SE2013/050215, dated Jul. 1, 2013, 4 pages.
Extended European Search Report (includes Supplementary European Search Report and Search Opinion) received for European Patent Application No. 13772373.0, dated Dec. 14, 2015, 7 pages.
Office Action received for Australian Patent Application No. 2013244044, dated Aug. 10, 2016, 2 pages.

* cited by examiner

APPARATUS FOR DRILLING AND LINING A BOREHOLE

CROSS REFERENCE TO RELATED APPLICATIONS

This application is a U.S. National Phase patent application of PCT/SE2013/050215, filed on Mar. 11, 2013, which claims priority to Swedish Patent Application No. 1250345-4, filed on Apr. 4, 2012, the entire contents of which are incorporated herein by reference.

BACKGROUND OF THE INVENTION

Field of the Invention

The present invention concerns apparatus for a drill for down-the-hole drilling and the installation of a lining pipe in rock or soil layers according to the introduction to claim 1.

Description of the Related Art

Drills are used in prior art drill arrangements for the installation of a lining pipe, i.e. in which a lining pipe is to be left permanently in a borehole after, for example, drilling in loose rock, or in which fluids such as water or oil are to be led into the pipe, that demonstrate a central pilot drill bit that is intended to be mounted in a chuck in a down-the-hole drill using a shaft or a neck, from which impacts are transferred to the pilot bit. A control means guides the drill and the lining pipe relative to each other such that the drill can be freely rotated relative to the lining pipe. A coupling arrangement, normally in the form of a bayonet coupling, is located between the drill and the control means, which coupling arrangement when in its free condition allows the drill to be drawn back through the lining pipe together with the down-the-hole drill. The drill is intended to drill a borehole that allows the lining pipe to accompany it into the borehole. A casing shoe, which has been welded at a forward end of the lining pipe, ensures that the lining pipe is driven into the borehole together with the drill and transfers impacts from the drill to the lining pipe. The drill has internal flushing passages for the supply of flushing agent, and it has evacuation passages for the removal of drilling cuttings together with the flushing agent. Drilling takes place through a combination of impacts and rotational movement.

The transfer of impacts to the lining pipe takes place in prior art drill arrangements through the casing shoe through a forward impact surface that is a part of the drill bit acting on a rear impact surface of the casing shoe and initiating the casing shoe in this way into intermittent, axial impact motion, which is in turn transferred to the lining pipe. One problem with this design is that the output power of the hammer that is a part of the impact mechanism must be limited such that the impact energy is not sufficiently great that the welded join between the casing shoe and the lining pipe breaks. The welded join between the said parts that transfer impact energy thus constitutes a weak point. Even if the weld is of high quality, the impact energy must normally be limited when installing a lining pipe. As a consequence of the low power of the impact mechanism, the desired drilling rate is not obtained, and thus also the total capacity of the equipment used to install a lining pipe is limited.

Furthermore, if the force of feeding is too low, also the problem that the drill bits become polished arises, which means that they soon loose their cutting capacity. The drill bit may in the worst case be destroyed due to the overheating that arises. It should be realised that the possibilities for the operator to observe a broken welded join between the casing shoe and the lining pipe or a reduced drilling rate due to the loss of cutting capacity of the drill bit are limited, and that repairs to the equipment in question are both time-consuming and expensive. There is, thus, a desire to make it possible to drive this type of drill arrangement with a considerably higher hammer power than previously, not only in order to obtain an increased drilling rate but also to reduce the risk of polishing of the drill bit arising.

Drills are known from WO 9934087 A1 and US 2004/0104050 A1 that drive a lining pipe into a hole through the transfer of direct impacts from pilot bit to the lining pipe through a casing shoe. A drill is known from DE 4000691 A1 that presses a lining pipe into a borehole through the interaction between a casing shoe and a stationary part of the drill, which parts cannot be rotated at their opposing contact surfaces.

SUMMARY OF THE INVENTION

A first purpose of the present invention, therefore, is to achieve an arrangement at a drill for the installation of a lining pipe that allows a significantly improved drilling rate and at the same time reduces the risk of failure due to failure of the welded join between the casing shoe and the lining pipe. A second purpose of the invention is to achieve an arrangement at a drill that makes it possible to carry out the installation of a lining pipe without any noteworthy reduction in the power of the impact mechanism, i.e. to install a lining pipe at essentially full hammer power. It is appropriate that the drill arrangement according to the invention is used with a fluid-powered down-the-hole hammer drill.

It has surprisingly proved to be the case that efficient water flushing in front of the drill bit has a lubricant effect that in nearly all cases achieves such a reduction in the friction between the surrounding wall of the cavity in the soil layers and the lining pipe that the percussive force that prior art drills have applied to the lining pipe through the casing shoe for the driving of the lining pipe into the borehole is not necessary: the force of pressure (not of impacts) that can be transferred through a suitable selected stationary part of the down-the-hole hammer drill is, in nearly all cases, sufficient. Since the casing shoe in the present invention does not function as a percussive component, it is more correct in principle that it be known as, due to its functionality, a collar of the lining pipe, or a casing collar.

The two purposes of the invention are achieved through a drill arrangement for down-the-hole drilling with the installation of a lining pipe that demonstrates the distinctive features and characteristics specified in claim 1. The drill arrangement includes essentially a combination of a specially designed drill and a down-the-hole hammer drill. Further advantages of the invention are made clear by the non-independent claims.

BRIEF DESCRIPTION OF THE DRAWINGS

An embodiment of the invention will be described below in more detail with reference to attached drawings, of which.

DETAILED DESCRIPTION OF THE INVENTION

Figure 1:
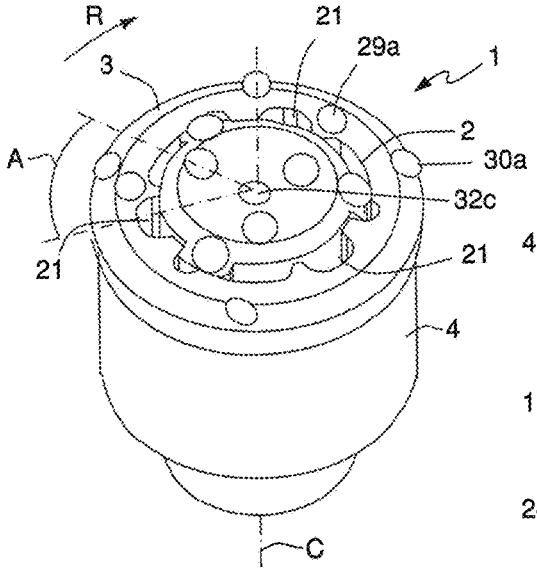
FIG. 1 shows a perspective view of a forward part of an arrangement at a drill according to the present invention.
Figure 2:
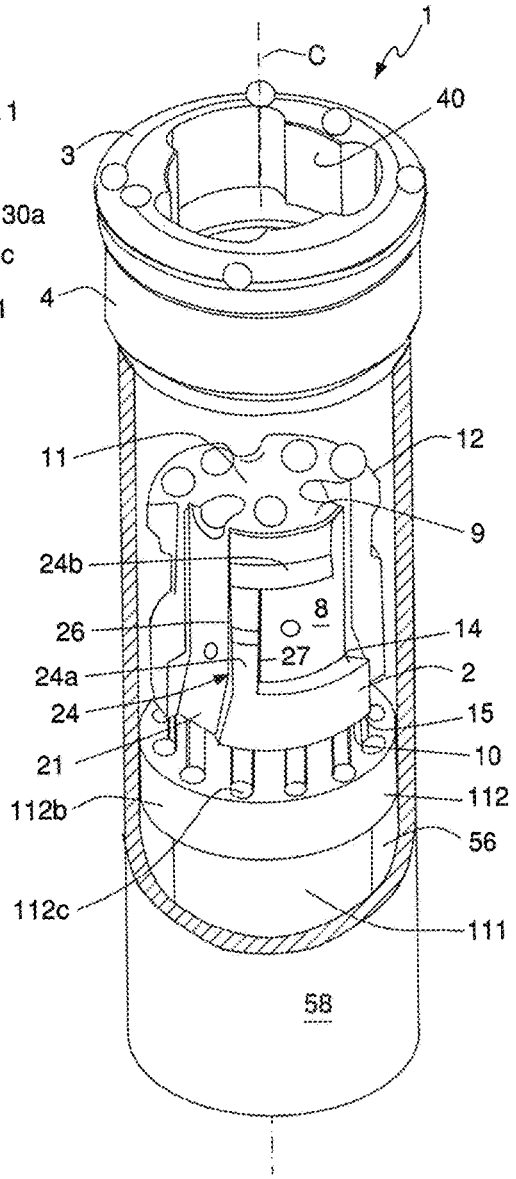
FIG. 2 shows a partially cut-away perspective view of a ring bit that is a component of the drill arrangement and [syntax, missing "where a"?] casing shoe is coupled at the forward end of a lining pipe whereby a pilot drill bit that is a component of the drill is freed from the ring bit and withdrawn a certain distance back from the lining pipe.
Figure 3:
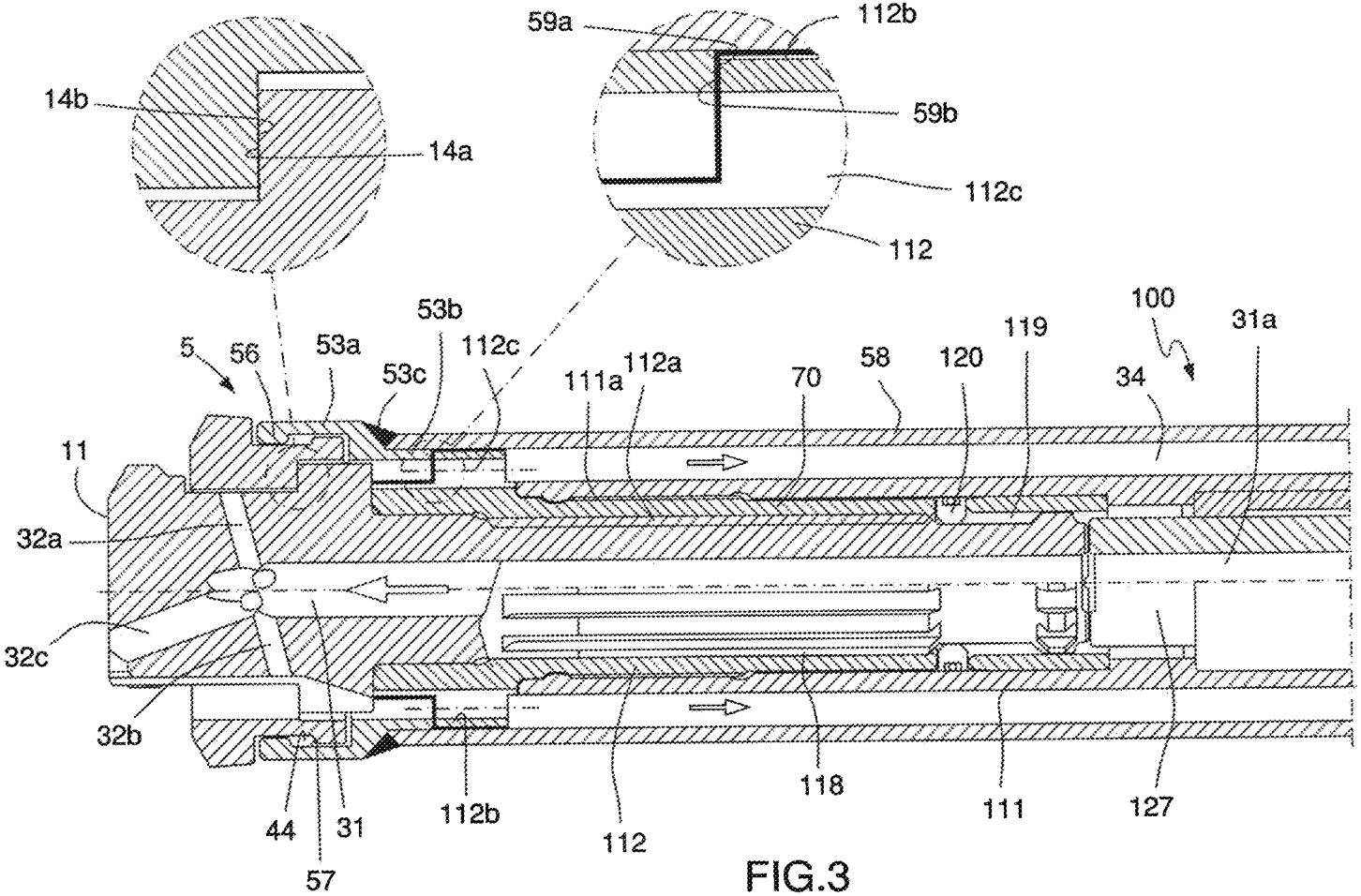
FIG. 3 shows a longitudinal section through the drill according to the invention.
Figure 4:
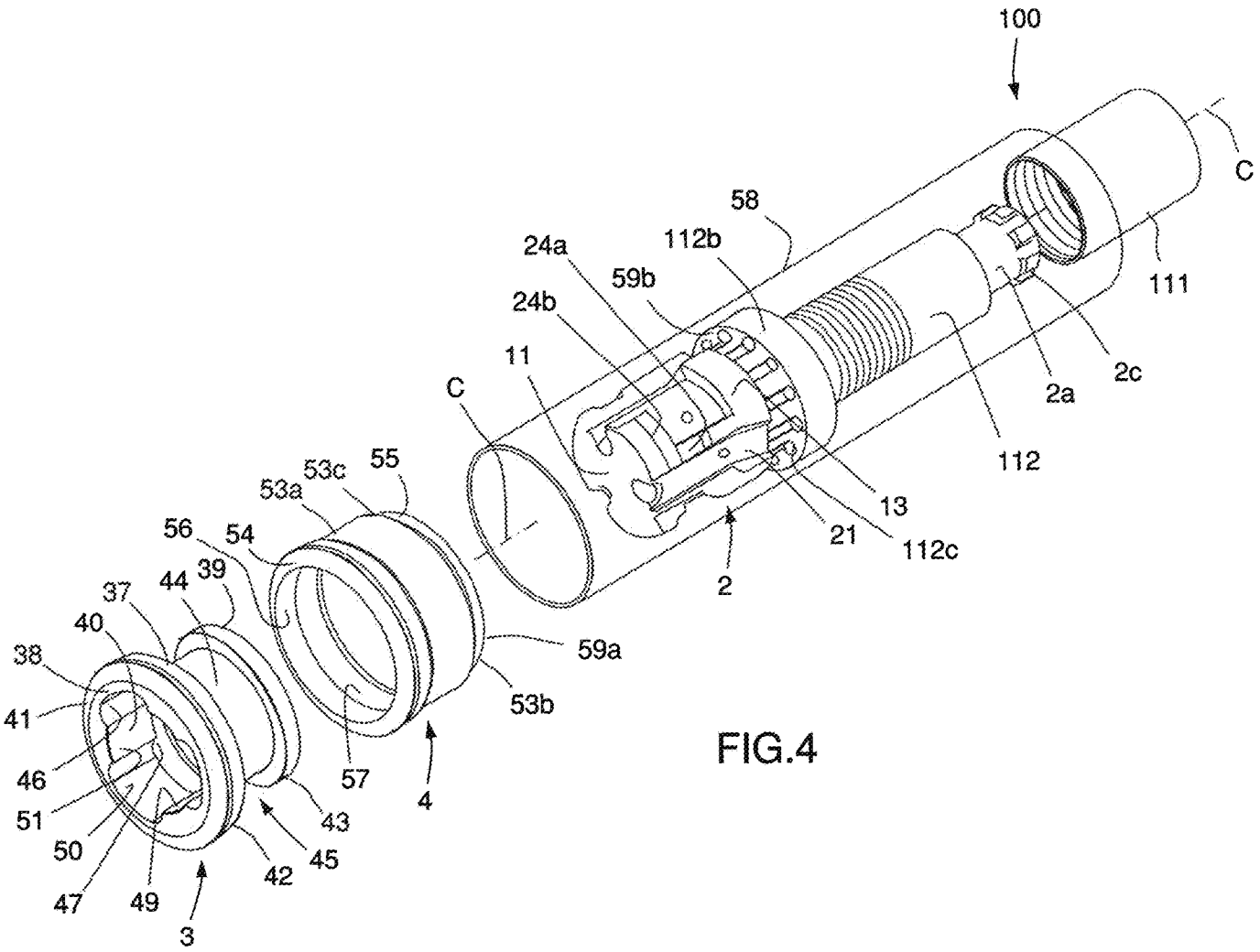
FIG. 4 shows a fragmentary X-ray view of a drill arrangement according to the invention with separated parts, whereby parts that are components of an impact mechanism that is a part of the drill have been excluded for reasons for clarity.

The drill arrangement shown in FIGS. 1-4 is a combination of two principal components, namely a drill 1 for installing a lining pipe and a water-powered down-the-hole hammer drill 100, known as a DTH drill, as is shown most clearly by FIGS. 3 and 4. A down-the-hole hammer drill differs from a top hammer drill in that the drill is passed down into the hole and works directly with the drill bit at the bottom of the borehole. Since the down-the-hole drill normally carries out solely the impact function, rotation and feed of the drill string take place by means of equipment outside of the hole. As an example of a down-the-hole hammer drill, reference can be made to the water-driven models that are marketed under the tradename Wassara® and that are described in, among other documents, SE 526 252.

The drill 1 that is described below is essentially already known. In this part it should be understood that the invention can be applied to a number of different types of known drills, not only of the type that is described below for the purposes of an example and that demonstrates a central pilot drill bit with a ring bit that surrounds this, but also of the type of available excentric system that, lacking a ring bit, work with spacers that can be radially extended and that has a separate control means that acts between the drill bit and the lining pipe for the mutual guidance of the drill and the lining pipe.

With reference to FIGS. 1 and 2, there is shown a drill 1 that is a component of the present drill arrangement, which drill consists of two parts, the drill bits of which comprise a crushing means. These crushing means are constituted by inserts of hard metal or other material that resists wear, with the task of crushing rock. The crushing means are anchored in indentations that are present in the end surfaces of the drill bit. The drill 1 includes a central pilot drill bit 2 and a ring bit 3 that surrounds this, which bits each have a basic form that is rotationally symmetrical relative to a geometric central axis and they include forward and rear ends, which bits are bound to each other by a coupling arrangement in a manner that allows them to be separated, which coupling arrangement, having a design of a bayonet coupling, allows the pilot bit to be freed from the ring bit and withdrawn from the borehole when the borehole has been completed.

As FIGS. 2 and 4 make clear, the pilot bit 2 has a basic form that is rotationally symmetric with a cylindrical surface 8 that is concentric with the central axis C and that extends between a forward and a rear end 9, 10. The forward end includes not only a central, plane end surface 11, but also a conical end surface 12 that surrounds it. A ring-shaped bulge or girdle 13 is formed at a certain distance from the forward end, which girdle is axially limited by the forward and rear ring-shaped end surfaces 14, 15. As is made most clear by the enlargement of detail at the left in FIG. 3, the forward ring-shaped surface 14 forms an impact surface 14*a* that is intended to interact with a corresponding impact surface 14*b* at the ring bit. It is intended that the pilot bit 2 rotates in the direction of the arrow R in FIG. 1 during drilling.

As is made clear by FIGS. 2 and 4, the ring girdle 13 is interrupted by three passages 21 that are evenly distributed around the circumference of the ring girdle and thus separated around the periphery.

The pilot bit 2 has three carriers 24 formed as L-shaped protrusions with essentially the basic form of a hook with the shape of a parallelepiped, which carriers are evenly distributed around the circumference of the surface 8. The carriers 24 demonstrate a first part 24*a* that extends along the longitudinal axis of the pilot bit and that is terminated at the forward end 9 of the pilot bit in a transverse second part 24*b*. This transverse second part 24*b* forms a hook that functions in the bayonet coupling. Each carrier 24 includes a forward end surface that forms a part of the forward end 9 of the pilot bit, together with two side surfaces 26, 27 and an outer surface. Reference letter A in FIG. 1 denotes the arc extent by which a carrier 24 is displaced around the periphery relative to a passage 21 in the ring girdle 13 that has been displaced by rotation.

As is made clear by FIG. 3, the rear end 10 of the pilot bit 2 opens out in a hole 31 that forms a part of a passage for flushing agent that includes, at the forward end of the pilot bit, two radially directed sections 32*a*, 32*b* of passage that open out into the surface of the pilot bit 3 between two neighbouring carriers and a third section 32*c* of passage that opens out into the end surface 11.

With reference to FIG. 1, it is there made clear that the section 32*c* of flushing passage opens out into the plane end surface 11 of the pilot bit, whereby flushing water that is supplied is distributed across the surface 11 from the opening 32*c*.

With reference to FIGS. 1 and 4, the ring bit 3 has, as has also the pilot bit 2, a basic form with rotational symmetry through the inclusion of a surface 37 that is concentric with the central axis C and that is slightly conical, together with two opposing ring-shaped surfaces 38, 39 that form the forward and rear ends of the ring bit. One inner surface, denoted by reference number 40, is cylindrical. A conical end surface 41 is located outside of the plane, ring-shaped forward end surface 38. FIGS. 1 and 2 show how crushing means in the form of hard metal inserts are mounted in both the plane end surface 38 and the conical end surface 41. It should be noted that the drill is shown in FIGS. 3 and 4 without the said crushing means, for reasons for clarity.

As FIG. 4 shows, a forward material part 42 that is surrounded by the surface 37 has a larger diameter than a rear material part 43. A circular groove 45 is formed in this way in a surface 44 between these material parts. A number of depressions in the inner surface 40 are formed internally in the ring bit 3. To be more precise, three first grooves 46 with separations of 120° are formed as depressions, which grooves extend axially between the forward and rear ends of the ring bit. These grooves 46 transition at their fronts each into a pocket 47 that extends sideways from the associated groove and that is limited partly by a bottom surface (not shown in the drawings) that extends perpendicularly from the central axis C, and partly by an axially directed contact surface (also not shown in the drawings). The grooves 46 and the pockets 47 form, together with the carriers 24*a*, 24*b*, the bayonet coupling that has been mentioned in the introduction above.

It is furthermore to be noted that second grooves 50 are formed in the region between neighbouring first grooves 46, which second grooves are located, similarly to the first grooves, with separations of 120° and extend axially between the forward and rear ends 38, 39 of the ring bit. Each such second groove 50 is separated from an adjacent first groove 46 by means of a ridge or separating wall 51, the inner surface of which forms a part of the inner surface 40 of the ring bit. Furthermore, a part having the nature of a shoulder having a smaller diameter of the rear plane end surface 39 of the ring bit 3, the impact surface 14*b* at the ring bit 3 that is intended to interact with the impact surface 14*a* at the pilot bit 2.

With special reference to FIG. 4, the casing shoe 4 includes a basic form that is rotationally symmetrical with a forward and a rear surface 53*a*, 53*b*, each one of which is cylindrical and concentric with the central axis C. The casing shoe extends between the forward and the rear ends in the form of ring-shaped end surfaces 54, 55. The forward part 53*a* of the surface has a diameter that is greater than that of the rear part 53*b*. A groove-shaped depression 57 with a somewhat larger internal diameter is formed on the cylindrical inner surface 56 of the casing shoe 4. The rear end 53*b* of the casing shoe 4, which has a lower diameter, has been given an axial extent and an external diameter that are so selected with respect to the internal diameter of the lining pipe, denoted by reference number 58, that the rear part, designed as a tubular connection piece, fits into and can be taken up into the forward end of the lining pipe in order to form a contact surface 59*a* that extends radially in a protruding manner in towards the central axis C of the lining pipe 58, intended to interact with a stationary part of the down-the-hole hammer drill that functions as an opposing radially directed contact surface 59*b*. The contact surfaces 59*a* and 59*b* form a glide bearing. It should be noted that the transition between the forward part 53*a* and the rear part 53*b* is conical, in order to form a recess 53*c* for a welded join between the casing shoe 4 and the forward end of the lining pipe 58. As the right enlargement of detail in FIG. 3 makes clear, the ring-shaped rear end surface 55 of the casing shoe 4 of the tubular connection forms the axial contact surface 59*a* that is intended to interact with the stationary part (the non-percussive part) of the down-the-hole hammer drill 100 that is arranged concentrically in the lower part of the lining pipe, which stationary part is constituted in this case by a driver chuck sheath 112 that is arranged in the forward end of the down-the-hole hammer drill, but which could be constituted by any other suitable part, for example the machine housing or rear part of the down-the-hole hammer drill. This part of the invention will be described in more detail below.

The present drill arrangement is shown in FIG. 3 in its assembled condition whereby it is made clear that a ring-shaped protrusion 56 that is directed radially in towards the centre with a reduced internal diameter is limited between the forward end surface 54 of the casing shoe 4 and the forward axial limiting wall of the depression 57 that has the form of a groove. This ring-shaped protrusion 56 fits into and is located in the circumferential groove 45 that is formed in the surface 44 of the ring bit, and these parts together form a control means, generally denoted by reference number 5, that guides the drill and the lining pipe relative to each other. Thus the ring-shaped protrusion 56 and the groove-shaped depression 57 form together the control means 5 that ensure that the casing shoe 4 accompanies the ring bit 3 axially and that allows rotation of the ring bit relative to the casing shoe. In other words, the control means 5 makes it possible to guide the drill, consisting of the pilot bit 2 and the ring bit 3, and the lining pipe 58 lining pipe relative to each other. The axial width of the circumferential groove 45 is so adapted that the casing shoe 4 and the ring bit 3 accompany each other axially, but the casing shoe is essentially not influenced by the impacts that the pilot bit 2 exerts on the ring bit 3 through the interacting impact surfaces 14*a*, 14*b*, while free rotation of the ring bit 3 relative to the casing shoe 4 is permitted. The widths of the circumferential groove 45 and of the ring-shaped protrusion 56 are mutually adapted to each other such that the ring bit 3 is allowed to move axially relative to the casing shoe under the influence of the said impacts a certain distance that is somewhat larger than the amplitude of the impact, i.e. the ring-shaped protrusion 56 is offered a certain degree of free motion relative to the circumferential groove 45. Since the ring-shaped protrusion 56 and the circumferential groove 45 unite the ring bit and the casing shoe only axially, and not circumferentially, the ring bit 3 can rotate freely relative to the casing shoe 4.

As has been mentioned in the introduction, the present drill arrangement uses a down-the-hole drill, which has been given the general reference number 100.

As is best made clear by FIG. 3, the neck 2*a* of the pilot bit 2 is placed in a retaining manner in a chuck that is a component of the said down-the-hole drill, which chuck is concentrically placed within the lining pipe 58. The down-the-hole drill 100 demonstrates in a conventional manner a machine housing with a machine housing pipe 111, a driver chuck 112 that is fixed in the forward end of the machine housing pipe through, for example, a thread that is screwed into the pipe, and a rear end piece in the form of a drill string adapter (not shown in the drawings), preferably attached to the rear end of the machine housing pipe through being screwed in. A drill string (not shown in the drawings) formed from connected drill rods can be fixed into the end piece in known manner. The drill string of the down-the-hole drill 100 thus extends axially and concentrically inside the string of connected lining pipes 58. The driver chuck 112 holds the neck 2*a* of the pilot bit 2. The neck 2*a* has a splined coupling 118 to the driver chuck 112, and a part 119 that does not have splines. A ring 120 is clamped between the bushing 112 and the machine pipe 111, and prevents the drill bit from falling out. The ring 120 is axially divided such that it is possible to mount it. Thus, the pilot drill bit 2 can move axially between a rear end position in which it is shown with the head 2*c* supporting against the end of the bushing 112 and a forward position at which the rear part 21 of the splines of the neck 2*a* rests on the ring 20. The pilot drill bit has a central flushing passage 31 that passes from its neck 2*a* to the forward end of the bit, for the supply of flushing fluid.

With continued reference to FIG. 3, the forward end of the machine housing pipe 111 is provided in conventional manner with an internal thread 111*a*, and the rear part of the driver chuck 112 is provided with a corresponding external thread 112*a* such that the driver chuck can be anchored in the forward end of the machine pipe 111 by screwing. The driver chuck 112 demonstrates a forward radially extended part 112*b*, like a flange, that defines a ring-shaped surface, the external diameter of which is adapted to the internal diameter of the lining pipe and the axial extension of which has been so selected that the surface can interact in a manner that allows sliding with the inner surface of the lining pipe 58, in order in this way to be rotated and axially displaced into the lining pipe through the influence of the rotation and feed of the drill string that take place in a conventional manner by means of drill equipment that is located outside of the borehole. The flange 112*b* of the driver chuck 112 that is directed radially outwards from the centre C thus forms a contact surface 59*b* that is directed axially towards the bottom of the borehole, which contact surface is intended to interact inside the lining pipe 58 with the radial contact surface 59*a* arranged as a part of the tubular connection of the casing shoe 4. A piston 127 is arranged behind the drill bit 2 whereby the piston can be displaced forwards and backwards in the axial direction inside of the outer tube 111. The piston 127 is provided with a drilled indentation that extends axially and that forms a central passage 31*a* for the flushing agent, a flow of flushing agent forwards to the openings in the pilot bit 2. Rotational transfer between the neck 2*a* of the pilot drill bit 2 and the driver chuck 112 is achieved with the aid of the said splines both on the outer surface of the shaft and on the wall of the cavity of the driver chuck. For the evacuation and removal of drilling cuttings together with flushing agent, the flange-like part 112*b* of the driver chuck 3 that extends radially is penetrated by a series of passages 112*c* directed in the axial direction, which passages in the form of drillings are evenly distributed around the circumference of the part and thus separated around the periphery. Between the outer surface of the machine pipe housing 111 of the down-the-hole drill, and at one of the ends of the drill string (not shown in the drawings) formed from connected drill rods, and the inner surface of the lining pipe 58, a ring-shaped passage 34 is limited for leading a flow of drilling cuttings out from the borehole. Through the influence of a rotation arrangement outside of the borehole, a rotational motion is transferred to the drill string that is transferred to the machine pipe housing 111; the driver chuck 112 transfers the rotational motion to the drill bit 1 such that this rotates a pre-determined number of degrees in association with each impact.

The drill arrangement is shown in FIG. 4 in an X-ray view with separated parts. Among other things, the drawing makes clear how the casing shoe 4 is intended to be welded onto the forward end of the lining pipe, and how the driver chuck 112 is fixed attached at the machine housing pipe 111 of the drill. Furthermore, the drawing illustrates how the central pilot drill bit 2 and the ring bit 3 can be connected in a manner that allows them to be separated by means of a bayonet coupling that allows the pilot bit to be freed from the ring bit and withdrawn from the borehole and the lining pipe together with the hydraulic drill when the borehole has been completed.

The drill arrangement for installing a lining pipe described above functions in the following manner:

When a hole is to be drilled for the purpose of installing a lining pipe in rock or soil, the relevant lining pipe 58 is first united with the casing shoe 4 by welding. In the next step, the ring bit 3 is connected to the casing shoe 4. The drill 100 is prepared in a following step by the driver chuck 112 being fixed into the forward end of the machine housing pipe 111 of the drill and the neck 2*a* of the pilot bit 2 being brought into contact in a retaining manner, inserted into the chuck that is a component of the drill. In a final step, the ring bit 3 is connected to the pilot bit 2. This takes place through the drill 100 being introduced into the lining pipe 58 and through the carriers 24 of the pilot bit 2 being axially introduced through the grooves 46 until they are located at the level of the pockets 47 at the forward end of the ring bit. The pilot bit is subsequently rotated in the direction of rotation R of the tool such that the drive surfaces 26 at the carriers 24 make contact with the contact surfaces 49 that are part of the pockets 47. The drill in this condition is now ready for the drilling operation. The drill is thus located concentrically inserted into the lining pipe 58.

Drilling takes place through a combination of impacts and rotational movement, whereby the rock is crushed by the crushing means of the drill bit. To be more precise, the impacts are transferred directly to the crushing means of the pilot bit 2, partly to the crushing means of the ring bit 3 through the influence of the pilot bit through the interacting impact surfaces. Since the ring-shaped lower end surface 55 of the casing shoe forms a contact surface 59*a* that interacts with the stationary part 59*b* (part that does not make impacts) that is constituted by the driver chuck of the down-the-hole hammer drill, the lining pipe will be driven into the borehole under the accompaniment of the drill through its driver chuck. Transfer of impact motion between the pilot bit and the ring bit takes place without any influence at all of the casing shoe, which can move axially along the ring bit with the required degree of freedom, guided and connected through interaction with the radially inwards-facing protrusions 56 of the casing shoe and the circumferential grooves 44 in the surface of the ring bit 3. The rotation of the ring bit relative to the casing shoe, and thus to the lining pipe, that is required for the ring bit to accompany the pilot bit in order to intermittently displace the crushing means that are a component of the ring bit occurs by means of the carriers 24 that are held in interaction with the pockets 47 of the ring bit.

During the drilling, when the carriers 24 interact with the pockets 47, flushing water and the accompanying drilling cuttings are evacuated through the passages that are limited on one side by the channels 50 in the inner surface of the ring bit 3 and on the other side by the surface 8 of the pilot bit 2. The channels 50 in this position are located axially aligned with a rear passage 21 through the ring girdle on the pilot bit 2. This means that the flows of flushing water through the drill take place through passages in the form of second channels 50, which are separated from the first channels 46, as is required for the application of the carriers 24 of the bayonet coupling in a locked, driving condition. In other words, the individual flow of contaminated water is directed linearly through the channel 50 and the axial rear passage 21 in the ring girdle 13. When the pilot bit 2 is to be freed from the ring bit 3 and withdrawn from the borehole, when the borehole has been completed or when surveillance and monitoring must be carried out, the pilot bit is rotated through an arc extent in the direction that is opposite to the direction R of rotation. The carriers 24 are in this way placed into locations in line with the channels 46 and can be withdrawn backwards through these, and further backwards together with the down-the-hole drill 100 out of the lining pipe 58 that remains in the hole.

A significant advantage of the invention is that forces of impact from the hammer mechanism are transferred essentially exclusively from the pilot bit 2 to the ring bit 3 through the carriers 24 of the bayonet coupling. Thus, the casing shoe 4 is in principle insulated from impacts. Instead, the lining pipe 58 will be driven into the borehole under the accompanying drill 100 through a stationary part that is constituted in the present case by the driver chuck 112 of the drill. Due to the welded join between the casing shoe 4 and the lining pipe 58 not being subject to impacts from the impact mechanism, the drill can be driven at essentially full power, which contributes to an increase in drilling rate and thus also a significantly improved total capacity. Due to the flushing of water in front of the drill bit, a lubricating effect is obtained that reduces the friction between the wall of the cavity and the lining pipe to such an extent that the percussive force that is applied through the casing shoe in prior art arrangements for the driving of the same is not necessary: the force of pressure (not of percussion) that is applied to the lining pipe through the interaction with the driver chuck of the down-the-hole drill is sufficient.

The invention is not limited to what has been described above and shown in the drawings: it can be changed and modified in several different ways within the scope of the innovative concept defined by the attached patent claims.

The invention claimed is:

1. An arrangement at a drill for down-the-hole drilling, intended to be used to drill a hole in front of a following lining pipe, comprising:

a drill bit with a shaft or a neck;

a chuck in the down-the-hole drill, into which the drill bit is inserted and from which impacts are transferred to the drill bit;

a control mechanism that guides the drill and the lining pipe relative to each other and that allows the drill to rotate relative to the lining pipe;

a coupling arrangement in the form of a bayonet coupling with which the drill can be coupled to the control mechanism in a manner that allows the drill to be removed and that in a free condition of the coupling arrangement allows the drill, together with the down-the-hole drill, to be withdrawn through the lining pipe;

a flushing passage for the supply of flushing agent in front of the drill and an evacuation passage for the removal of drilling cuttings together the flushing agent; and a casing shoe that can be applied at the forward end of the lining pipe and that is intended to displace the lining pipe forwards and into a borehole through an interaction with a contact surface arranged at the casing shoe and a contact surface arranged at a stationary part of the down-the-hole drill, whereby the said contact surfaces form a glide bearing that allows the stationary part of the down-the-hole drill to rotate relative to the casing shoe, the stationary part being a radially protruding flange like part of the chuck.

2. The arrangement according to claim 1, whereby the two interacting contact surfaces are turned to face each other and arranged to interact within a compartment that is defined by the inner surface of the lining pipe.

3. The arrangement according to claim 1, whereby the two interacting contact surfaces are arranged in a plane that is perpendicular to the central axis of the lining pipe.

4. The arrangement according to claim 1, whereby the casing shoe demonstrates a protruding part that extends a certain distance radially in towards the centre of the lining pipe, at which part the contact surface of the casing shoe is arranged.

5. The arrangement according to claim 1, whereby the casing shoe comprises at its rear end a pipe collar, the end surface of which, protruding as a tubular connection a certain distance into the inner surface of a forward end of a lining pipe, forms the contact surface of the casing shoe.

6. The arrangement according to claim 1, whereby the radially protruding flange like part of the chuck is ring-shaped, and demonstrates an external diameter that has been chosen such that the surface of the part forms a control means that allows the down-the-hole hammer drill to interact with the inner surface of the lining pipe in a manner that allows sliding.

7. The arrangement according to claim 6, whereby the radially protruding flange like part is penetrated by one or several axially directed passages that form a part of a passage for flushing agent to lead a flow of drilling cuttings away from the drill bit.

8. The arrangement according to claim 7, whereby the axial passages comprise a number of axially directed holes or openings that are evenly distributed around the circumference of the radially protruding flange like part.

9. The arrangement according to claim 1, whereby a ring-shaped passage for the flow of flushing fluid for the evacuation and leading away of drilling cuttings from the bottom of the borehole is disposed between the inner surface of the lining pipe and a drill string that extends into the lining pipe and at whose lower end the down-the-hole drill is attached.

10. The arrangement at a drill according to claim 1, where the drill is of the type that comprises two drill bits that are provided with crushing means that include a central pilot drill bit and a ring bit that surrounds the central pilot drill bit, which individually have a basic form that is rotationally symmetrical relative to a geometry central axis, and including forward and rear ends, which two drill bits can be coupled to each other in a manner that allows them to be separated by means of a bayonet coupling that includes a number of pockets in one of the bits into which carriers that are part of the second bit can be introduced for the transfer of driving rotational motion from the pilot bit to the ring bit and that, when in the free condition, allow the pilot drill bit to be drawn back up through the lining pipe, whereby the pilot drill bit during operation is inserted into the chuck of the down-the-hole drill into which impacts are transferred from the said chuck to the pilot bit and onwards from the pilot bit to the ring drill bit through the bayonet coupling, wherein the casing shoe comprises;

a control means that is equipped with a coupling that is active between the casing shoe and the ring bit and that allows free motion, which coupling ensures through the influence of play that has been determined in advance in the axial direction of the coupling that the casing shoe, when not under the load of impacts, can accompany the ring bit during axial motion into a borehole and that at the same time allows through the influence of a rotatable bearing that is a component of the coupling the ring bit to rotate relative to the casing shoe, and a contact surface that extends in a protruding manner a certain distance radially in towards the centre of the lining pipe and which contact surface interacts, during motion of the down-the-hole drill forwards and into the borehole, with a contact surface of a stationary part of the down-the-hole drill in such a manner that these two surfaces form a glide bearing that allows the stationary part to rotate relative to the casing shoe.

11. The arrangement according to claim 10, whereby the casing shoe is designed as a ring-shaped sheath that demonstrates at its forward end a protrusion that is directed radially in towards the centre of the arrangement and that fits into and is inserted into a groove-shaped circumferential depression formed in the surface of the ring bit.

12. The arrangement according to claim 10, whereby the casing shoe extends between forward and rear ends in the form of ring-shaped end surfaces where the surface of a forward part that is a part of the casing shoe has a diameter that is larger than that of the surface of a rear part and where the said forward broader part of the surface is arranged to surround a part of the ring bit while the rear less broad part forms a tubular connection that can be taken up into the forward end of the lining pipe and where the rear ring-shaped end surface forms the contact surface that interacts with a stationary part of the down-the-hole drill.

13. The arrangement according to claim 12, whereby the transition between the forward part and the rear part of the casing shoe is a recess for a welded join between the casing shoe and the forward end of the lining pipe.

* * * * *